US010317845B2

(12) United States Patent
Zhang

(10) Patent No.: US 10,317,845 B2
(45) Date of Patent: Jun. 11, 2019

(54) SMART WRISTBAND WITH ROTATABLE DIAL

(71) Applicant: Qingdao GoerTek Technology Co., Ltd., Qingdao, ShanDong Province (CN)

(72) Inventor: Jianxin Zhang, Qingdao (CN)

(73) Assignee: QINGDAO GOERTEK TECHNOLOGY CO., LTD., Qingdao (CN)

( * ) Notice: Subject to any disclaimer, the term of this patent is extended or adjusted under 35 U.S.C. 154(b) by 0 days.

(21) Appl. No.: 16/072,451

(22) PCT Filed: Dec. 31, 2016

(86) PCT No.: PCT/CN2016/114036

§ 371 (c)(1),
(2) Date: Jul. 24, 2018

(87) PCT Pub. No.: WO2017/202022

PCT Pub. Date: Nov. 30, 2017

(65) Prior Publication Data

US 2019/0041806 A1 Feb. 7, 2019

(30) Foreign Application Priority Data

May 24, 2016 (CN) ..... 2016 1 0347386

(51) Int. Cl.
*G04C 17/00* (2006.01)
*A44C 5/00* (2006.01)
(Continued)

(52) U.S. Cl.
CPC ..... *G04C 17/0008* (2013.01); *A44C 5/00* (2013.01); *G04B 37/0033* (2013.01); *G04C 10/04* (2013.01)

(58) Field of Classification Search
CPC ..... G04C 17/0008; G04C 10/04; G04B 37/0033; G04G 17/08; A44C 5/003; A44C 5/0015; A45F 5/00
(Continued)

(56) References Cited

U.S. PATENT DOCUMENTS 6,360,928 B1 3/2002 Russo
7,529,155 B2 * 5/2009 Fasciano ..... G04G 9/0076 368/10
(Continued)

FOREIGN PATENT DOCUMENTS

CN 104238351 A 12/2014
CN 105768407 A 7/2016
(Continued)

OTHER PUBLICATIONS

Chinese Office Action, with English Translation, dated Jan. 25, 2017 issued in Chinese Application No. CN 201610347386.2.
(Continued)

*Primary Examiner* — Edwin A. Leon
(74) *Attorney, Agent, or Firm* — Arent Fox LLP

(57) ABSTRACT

A smart wristband with a rotatable dial has a dial, a case and a band. The case is embedded in the band. The dial is rotatably disposed in the case. An end of the dial is provided with a USB port, and the USB port is hidden between the dial and the case. The dial has a bottom case, a rotating ring is fixed at a bottom of the bottom case, the case is sandwiched between the bottom case and the rotating ring, and relative rotation between the dial and the case is achieved by the cooperation and relative rotation between the rotating ring and the case. An opening is provided at an end of the bottom case, a protruding buckling rib is provided at the
(Continued)

other end, and a buckling groove that matches the protruding buckling rib is formed at the corresponding position of the case.

8 Claims, 7 Drawing Sheets

(51) Int. Cl.
*G04B 37/00* (2006.01)
*G04C 10/04* (2006.01)

(58) Field of Classification Search
USPC ..... 368/282, 10; 224/222, 219, 267
See application file for complete search history.

(56) References Cited

U.S. PATENT DOCUMENTS

| | | | | |
|---|---|---|---|---|
| 8,328,055 | B1 | 12/2012 | Snyder | |
| 8,651,346 | B1 | 2/2014 | Williams | |
| 2006/0140055 | A1* | 6/2006 | Ehrsam | A44C 5/18 368/10 |
| 2007/0064542 | A1* | 3/2007 | Fukushima | G04B 37/1486 368/282 |
| 2014/0160896 | A1* | 6/2014 | Leoni | G04G 21/00 368/10 |
| 2015/0015502 | A1 | 1/2015 | Al-Nasser | |
| 2015/0332031 | A1 | 11/2015 | Mistry et al. | |
| 2016/0077495 | A1* | 3/2016 | Brown | G04F 10/00 368/11 |

FOREIGN PATENT DOCUMENTS

| | | | |
|---|---|---|---|
| CN | 205671641 | U | 11/2016 |
| JP | H10-224713 | A | 8/1998 |

OTHER PUBLICATIONS

Chinese Office Action, with English Translation, dated Sep. 27, 2017 issued in Chinese Application No. CN 201610347386.2.

International Search Report and Written Opinion dated Apr. 12, 2017 issued in International Application No. PCT/CN2016/114036.

* cited by examiner

SMART WRISTBAND WITH ROTATABLE DIAL

CROSS REFERENCE TO RELATED APPLICATIONS

This application is a U.S. National Stage entry under 35 U.S.C. § 371 based on International Application No. PCT/CN2016/114036, filed on Dec. 31, 2016, which was published under PCT Article 21(2) and which claims priority to Chinese Patent Application No. CN 201610347386.2, filed on May 24, 2016. The disclosures of these prior applications are hereby incorporated by reference herein.

TECHNICAL FIELD

The present disclosure belongs to the technical field of smart wristbands or wristwatches, and more specifically to a smart wristband with a rotatable dial.

BACKGROUND

Smart wristbands and wristwatches are typically charged by using USB charging port at the side or the bottom or copper pillar bumps at the bottom, or charged wirelessly. Two types of conventional charging structures are described in detail below.

As the first type, FIG. 1 depicts a conventional smart wristband charged by mini USB connection which is composed of a USB and a USB cover. The USB cover is typically made of a material such as TPU, TPE or silicone. In FIG. 1, 1 is the USB cover, 2 is the USB, and 3 is a lower case. When the smart wristband needs to be charged, the USB cover is opened; otherwise the USB is covered by the USB cover, so the USB cover must be opened and closed repeatedly. The internal USB is fixed on the lower case by an adhesive, and similarly, the inner side of the USB cover is fixed on the lower case by an adhesive. The main drawbacks of this type of charging method include: (1) the USB cover in FIG. 1 is made of a material such as TPU, TPE or silicone, so it is liable to be aging and peel off; and (2) the USB cover affects the appearance.

As the second type, FIG. 2 depicts a conventional smart wristwatch charged by copper pillar bumps, wherein a is a bottom case of the product, and b is charging copper pillars of the product. The internal copper pillars are usually welded to an FPC reinforcing plate. The FPC reinforcing plate is fixed to the bottom case by a double-sided tape. The main drawbacks of this type of charging method include: (1) the copper pillars are often in contact with the skin and are liable to be oxidized due to the sweat, and the rust formed on the surface of the copper pillar will affect the charging of the product; and most of these type of products on the market cannot pass the sweat test; (2) its manufacturing cost is high; and since it will affect the charging if copper pillars are in contact with a metal case, the copper pillar must be separated from the case by plastic, thereby increasing the manufacturing cost of copper pillars; and (3) a special-purpose charging base must be prepared, so it is costly and inconvenient.

In addition, FIG. 3 depicts a conventional wristwatch, wherein A is a display area of the wristwatch, and C simulates the state wherein a person's wrist is lifted up in which the font displayed is 90 degrees inclined. Most of the display areas of this type of wristwatch are of a rectangular shape. When people need to read data, it is inconvenient to read since the digits displayed and seen by people are 90 degrees inclined. Although some wristwatches have overcome the problem of inclination by rotating the digits by software design, the usable area of the screen will be reduced since the display screen is rectangular.

SUMMARY

An object of the present disclosure is to solve the problems in the prior art and provide a smart wristband with a rotatable dial. The smart wristband is designed so that the dial can be rotated relative to the case, and the charging port can be hidden.

To achieve the above object, the technical solutions of the present disclosure are as follows.

A smart wristband with a rotatable dial, comprising a dial, a case and a band, the case being embedded in the band, wherein the dial is rotatably disposed in the case, an end of the dial is provided with a USB port, and the USB port is hidden between the dial and the case.

A rotation structure of the dial is as follows: the dial comprises a bottom case, a rotating ring is fixed at a bottom of the bottom case, the case is sandwiched between the bottom case and the rotating ring, and relative rotation between the dial and the case is achieved by the cooperation and relative rotation between the rotating ring and the case.

Wherein, an opening is provided at an end of the bottom case corresponding to the USB port, the USB port passes through the opening, in order to facilitate rotating of the dial into position and keeping the stability after it gets into position, a protruding buckling rib is provided at the other end of the bottom case, and a buckling groove that matches the protruding buckling rib is formed at the corresponding position of the case. The protruding buckling rib is engaged with the buckling groove, and when the dial is being rotated, the engagement and disengagement between the protruding buckling rib and the buckling groove are corresponding to the engagement and disengagement between the dial and the case.

Specifically, the rotation structure of the dial is as follows:

the bottom case as a whole is of a shape of a box having an upper opening, and a first through hole is provided at a center of the bottom of the bottom case as a rotating shaft of the dial;

a second through hole having a stepped surface is provided at a portion of the case corresponding to the first through hole of the bottom case, and a rib is provided on an inner circumferential surface of the second through hole;

an annular boss in a circumferential direction of the first through hole is provided at a lower portion of the first through hole, and the annular boss is inserted into the second through hole and is fixedly connected with the rotating ring;

a top surface of the rotating ring comprises a first stepped surface and a second stepped surface from interior to exterior from higher to lower, the second stepped surface is provided with a groove of a certain angle, and the second stepped surface of the rotating ring is engaged with the inner circumferential surface of the second through hole; and when the dial is being rotated, the annular boss at the lower portion of the bottom case drives the rotating ring to rotate, and the second stepped surface of the rotating ring rotates along the inner circumferential surface of the second through hole of the case, and when a groove side of the rotating ring rotates to the position of a rib side, the rotation is blocked and stops, at this point the dial is rotated just to a desired angle; and when the dial is rotated backward, the dial returns to an original position.

Typically, the groove on the second stepped surface of the rotating ring has a sector angle of 120-300 degrees, and the rib on the case has a sector angle of 20-50 degrees.

In some embodiments, the rotating ring is a metal rotating ring, and a heart rate lens module is provided under the rotating ring.

In some embodiments, an FPC, a battery, a PCB, an LCD and a lens are provided sequentially in the bottom case from bottom to top, which are fixed with the bottom case by an adhesive.

In some embodiments, a portion of the bottom case corresponding to the protruding buckling rib is made of transparent plastic, and the transparent plastic area and a main body of the bottom case are integrally molded by using a two-color plastic injection molding machine; and an LED is provided at the bottom of an end of the PCB corresponding to the transparent plastic area of the bottom case, and the LED serves as an internal light source of the dial and also has a function of full charging alert, low battery alert, or call flashing reminder.

In order to facilitate the passing through of the light from the internal light source, and make the case and the band bright, the case is made of crystal black translucent hard plastic, and the band is made of translucent silicone soft plastic, both of which are light transmittable. The case and the band are formed integrally or separately.

The case is made of crystal black translucent hard plastic, and the band is made of translucent silicone soft plastic. Even if the case and the band are an integral structure, they have different characteristics. The case is a transparent hard plastic, the band is a soft plastic, and the case and the band may be formed by insert molding. The case is injection molded first, and then it is put into a silicone mold and molded again. Further, the case and the band may also be formed separately, and fixed by a structure such as a normal rotating shaft or a screw.

In some embodiments, both end faces of the bottom case in the length direction and corresponding inner sides of the case are concentric arc surfaces, and the dial as a whole rotates along a circular orbit.

Compared with the prior art, the advantageous effects of the present disclosure are as follows:

(1) the problem that copper pillar charging terminals externally exposed cannot pass the sweat test can be solved;

2) the problem of aging and yellowing of the USB cover due to long time use can be solved;

3) the cost of the structure in an ordinary charging port method can be reduced;

4) the problem that when the product is worn on the wrist, the content of the display area is inclined 90 degrees with respect to the human eye can be solved; and 5) the decorative lighting effect can be enhanced.

According to the present disclosure, the whole structure is simple, the manufacturing cost is low, the assembly is convenient, the operation is simple, and the waterproof effect is good.

BRIEF DESCRIPTION OF DRAWINGS

The present disclosure will be further described below with reference to the accompanying drawings and embodiments. In the drawings.

DETAILED DESCRIPTION

Figure 1:
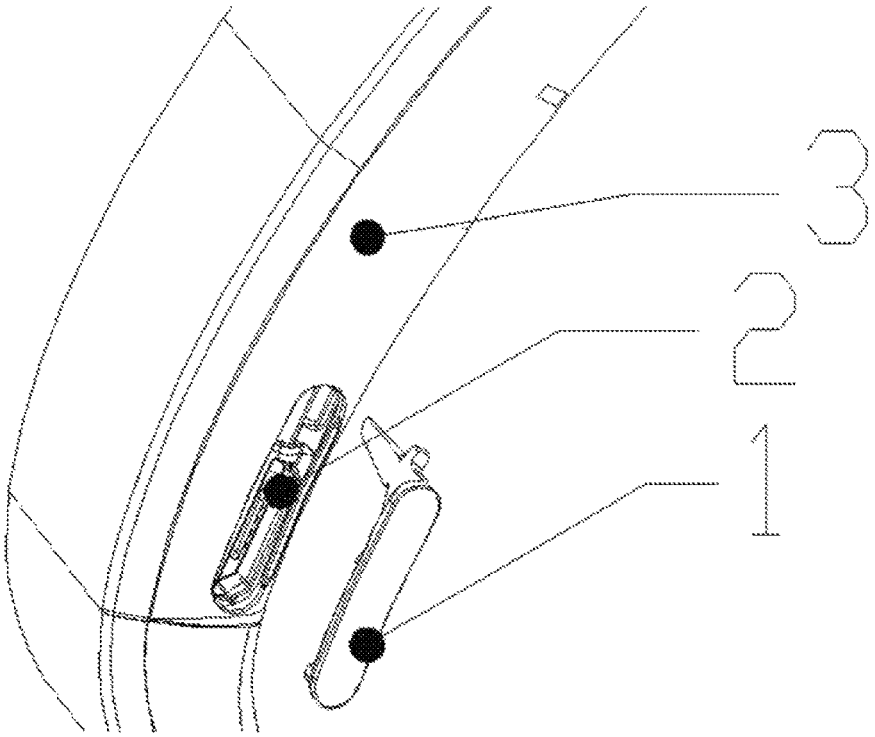
FIG. 1 (Prior Art)
FIG. 1 is a schematic view of a part of the structure of a conventional smart wristband that is charged at the side by a USB method.
Figure 2:
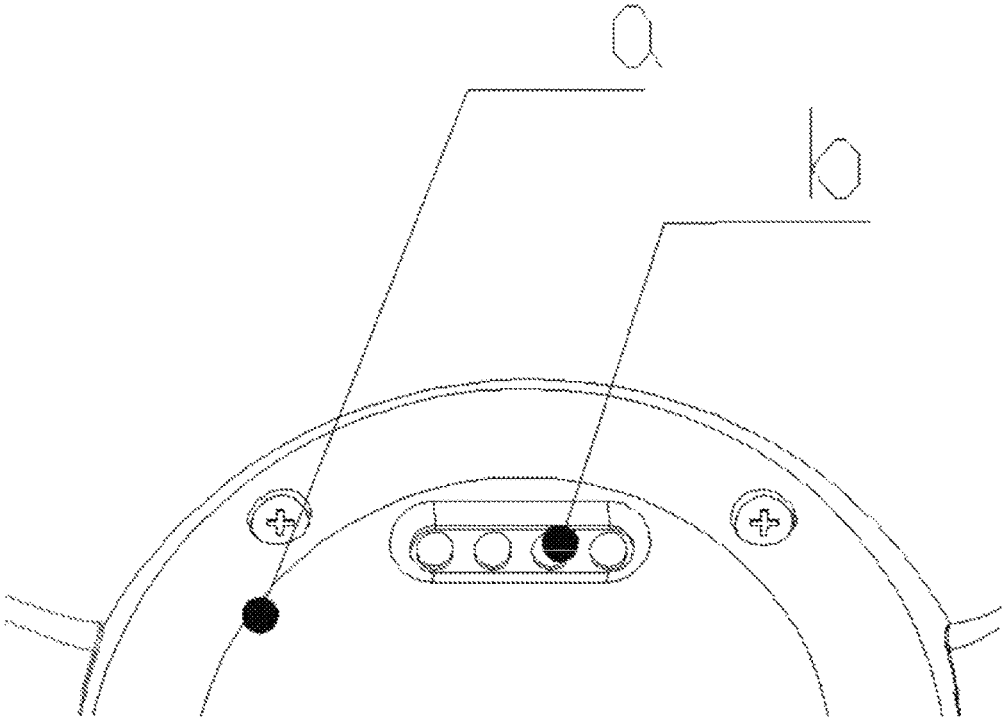
FIG. 2 (Prior Art)
FIG. 2 is a schematic view of a part of the structure of a conventional smart wristband that is charged at the bottom by a copper pillar bump method.
Figure 3:
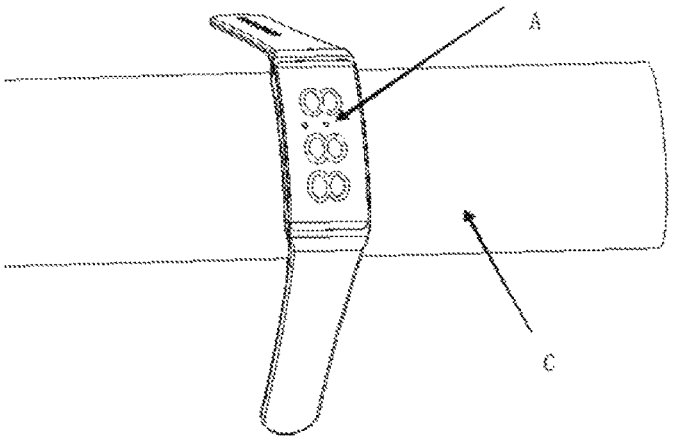
FIG. 3 (Prior Art)
FIG. 3 is a conventional wristwatch in which the font displayed is 90 degrees inclined.

In order to make the objectives, technical solutions and advantages of the present disclosure clearer, the present disclosure is further described in detail with reference to the accompanying drawings and the embodiments. It should be understood that, the particular embodiments described herein are only used to explain the present disclosure and are not intended to limit the present disclosure.

In the description of the present disclosure, it should be understood that, the terms that indicate orientation or position relationships, such as "center", "upper", "lower", "left", "right", "top", "bottom", "inner" and "outer", are based on the orientation or position relationships shown in the drawings, and are merely for conveniently describing the present disclosure and simplifying the description, rather than indicating or implying that the device or element must have the specific orientation and be constructed or operated according to the specific orientation. Therefore, they should not be construed as a limitation on the present disclosure. Furthermore, the terms "first" and "second" are merely used for the purpose of describing, and should not be construed as indicating or implying the degree of importance or the number of the indicated technical features. Therefore, the features defined by "first" or "second" may explicitly or implicitly comprise one or more of the features.

In the description of the present disclosure, it should be noted that, the term "connect" should be interpreted broadly, unless explicitly defined or limited otherwise. For example, it may be fixed connection, detachable connection, or integral connection; it may be mechanical connection or electrical connection; and it may be direct connection or indirect connection by an intermediate medium, and may be the internal communication between two elements. A person skilled in the art can determine the particular meaning of the term in the present disclosure concretely.

The present disclosure provides a smart wristband in which the dial can rotate as a whole, and the USB charging port can be hidden between the case and the dial and can only be seen by rotating the USB port of the dial when being charged or being used for illuminating.

The specific structure is described in detail in the following embodiment.

Figure 4:
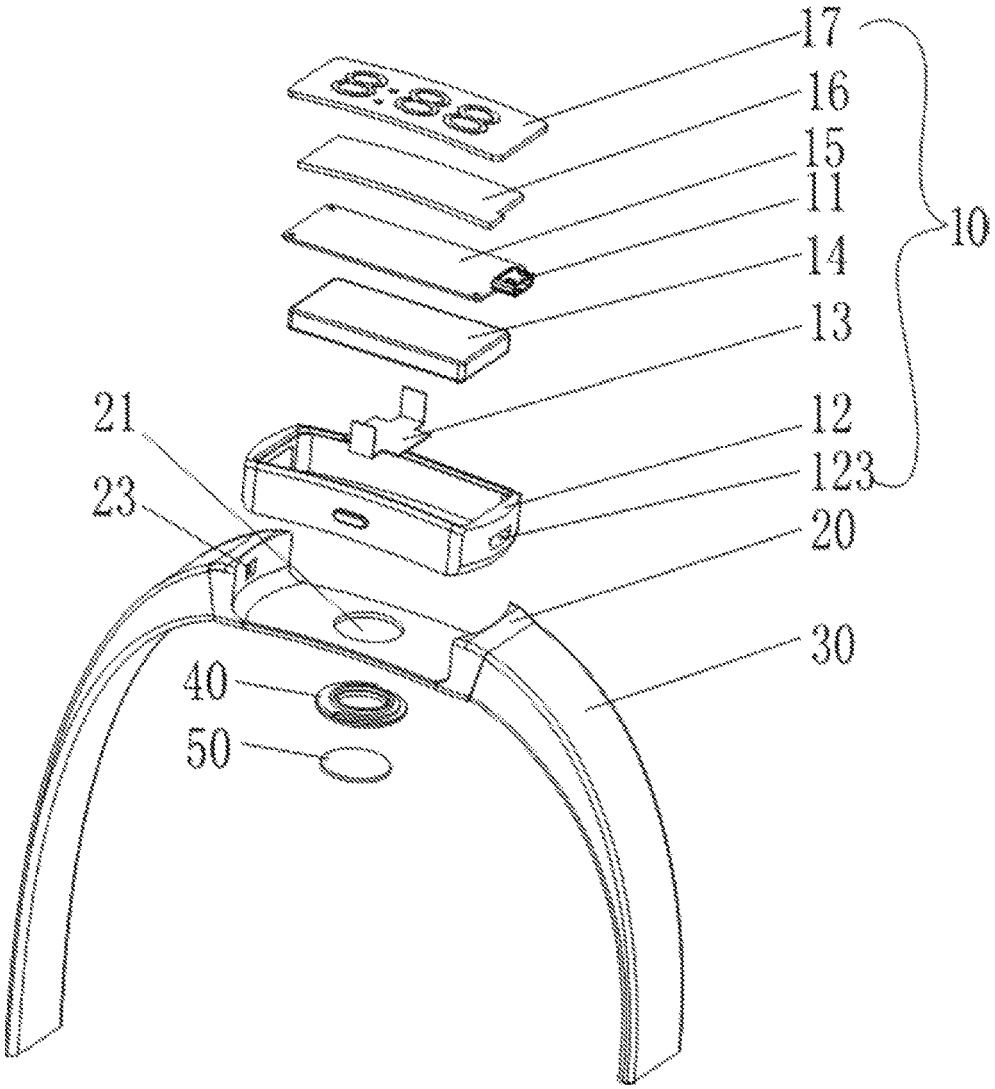
FIG. 4 is a schematic exploded view of an overall structure of a smart wristband according to a particular embodiment of the present disclosure.
Figure 8:
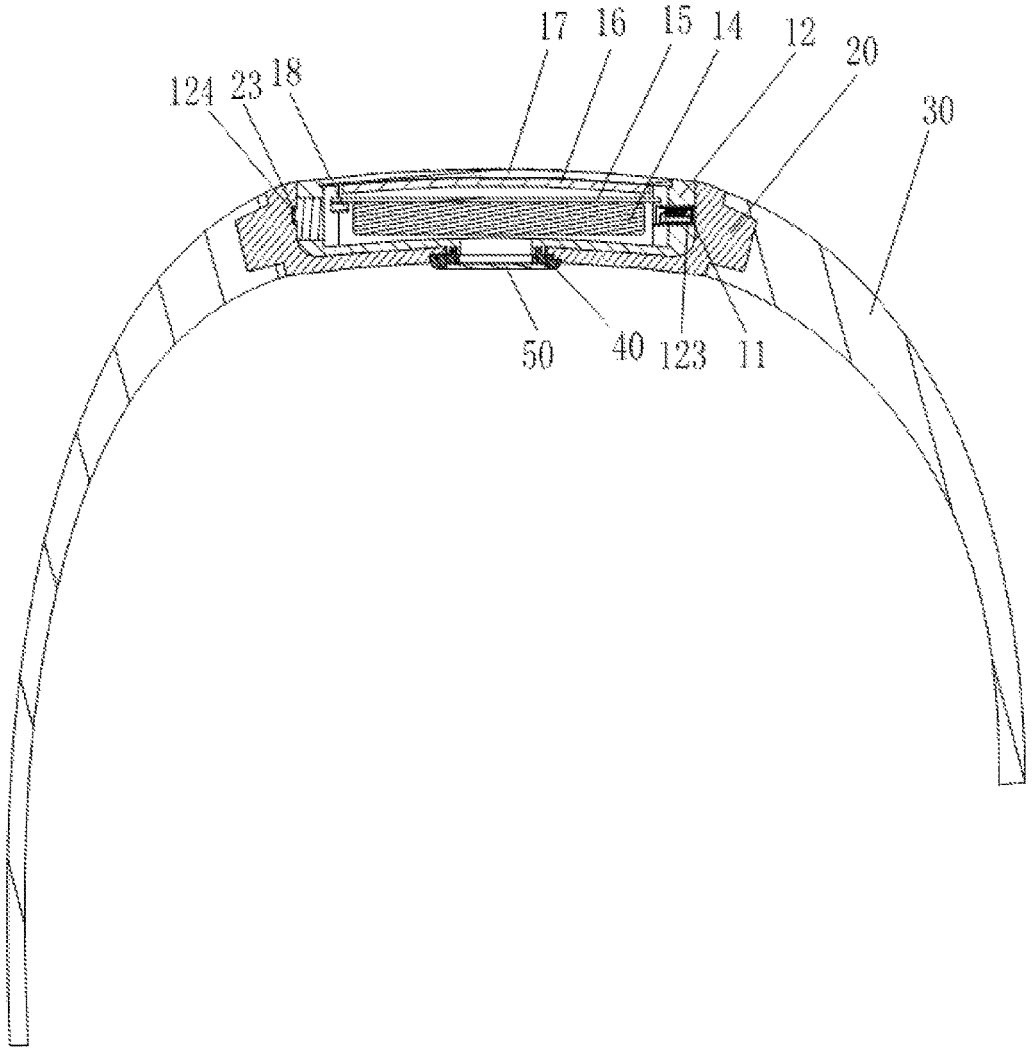
FIG. 8 is a half sectional view of a smart wristband according to a particular embodiment of the present disclosure.

Referring to FIG. 4 and FIG. 8, the smart wristband comprises a dial 10, a case 20 and a band 30. The case 20 is embedded in the band 30; that is, the band 30 is located at both sides of the case 20. A USB port 11 is provided at an end of the dial 10, and the USB port 11 is hidden between the dial 10 and the case 20. The dial 10 is rotatably disposed in the case 20.

In the present embodiment, the dial 10 comprises a bottom case 12, and an FPC 13, a battery 14, a PCB 15, an LCD 16 and a lens 17 are provided in the bottom case 12 in this order from bottom to top. The bottom case 12 and the components in it are mutually fixed by the adhesive, the FPC 13 and the bottom case 12 are fixed on the bottom of the bottom case by a double-sided tape, and then the FPC 13 crosses the bottom of the battery 14 and is connected with the PCB 15 through a connector.

In the above embodiment of the present disclosure, the rotation structure of the dial 10 is as follows.

Referring to FIGS. 5-9, a rotating ring 40 is fixed at the bottom of the bottom case 12. The rotating ring 40 may be a metal rotating ring. A heart rate lens module 50 is provided under the rotating ring 40.

The case 20 is sandwiched between the bottom case 12 and the rotating ring 40, and the relative rotation between the dial 10 and the case 20 is achieved by the cooperation and relative rotation between the rotating ring 40 and the case 20.

Specifically, the rotation structure of the dial 10 is as follows.

Figure 5:
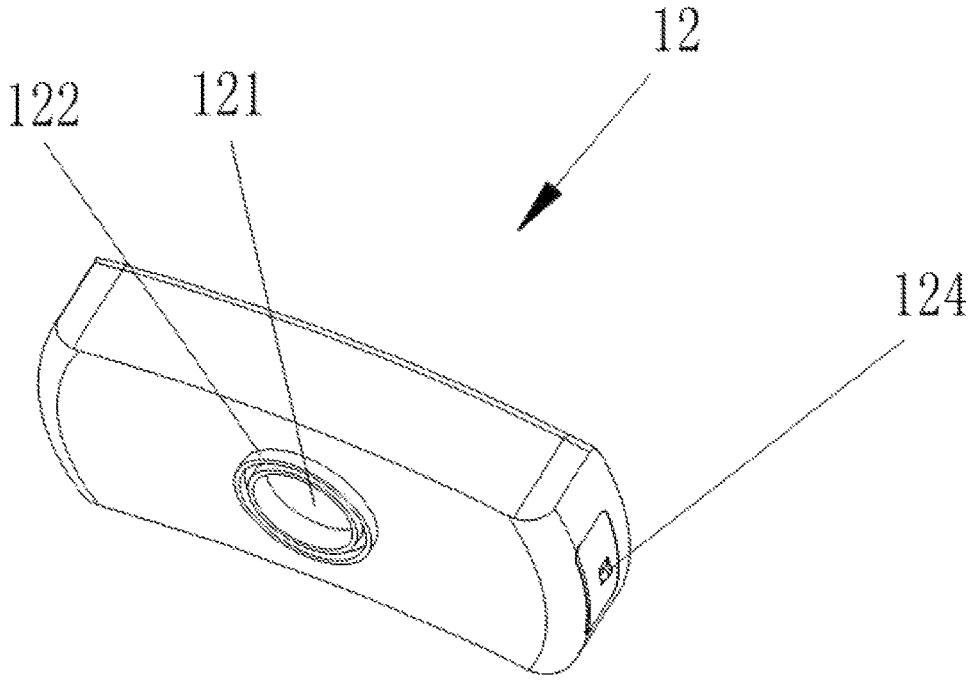
FIG. 5 is a schematic view of the structure of a bottom case.

As shown in FIG. 5, the bottom case 12 as a whole is of a shape of a box having an upper opening, and a first through hole 121 is provided at the center of the bottom of the bottom case 12 as a hollow rotating shaft of the dial 10.

As shown in FIG. 8, a second through hole 21 having a stepped surface is provided at a portion of the case 20 that is corresponding to the first through hole 121 of the bottom case 12. A rib 22 is provided on the inner circumferential surface of the second through hole 21.

An annular boss 122 in a circumferential direction of the first through hole 121 is provided at a lower portion of the first through hole 121. The annular boss 122 is inserted into the second through hole 21 and is fixedly connected with the rotating ring 40. An annular groove is provided on the top surface of the annular boss 122 for connecting and fixing the rotating ring.

Figure 9:
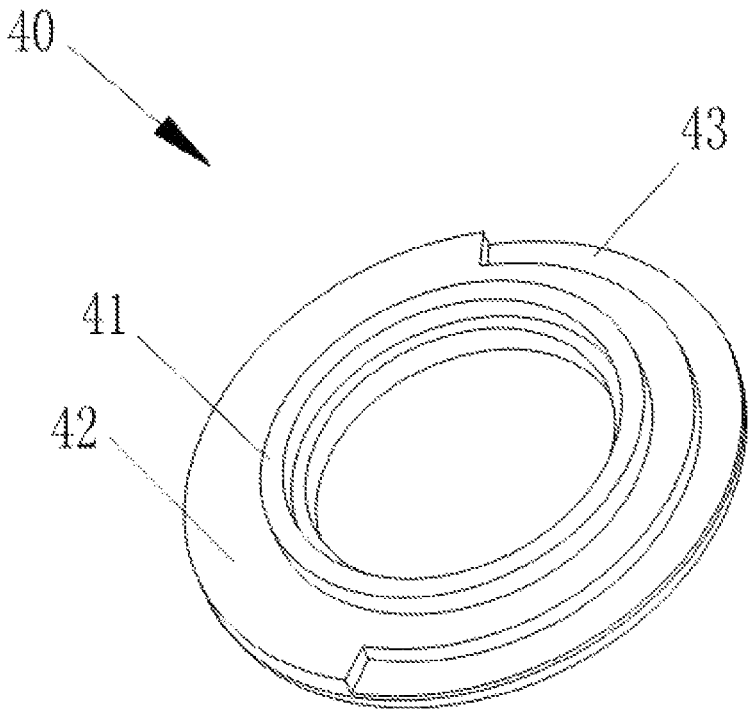
FIG. 9 is a schematic view of the structure of a rotating ring.

As shown in FIG. 9, the top surface of the rotating ring 40 comprises a first stepped surface 41 and a second stepped surface 42, and the first stepped surface 41 is located inside and is higher than the second stepped surface 42. The second stepped surface 42 is provided with a groove 43 of 200 degrees. The second stepped surface 42 of the rotating ring 40 is engaged with the inner circumferential surface of the second through hole 21.

When the dial 10 is being rotated, the annular boss 122 at the lower portion of the bottom case 12 drives the rotating ring 40 to rotate, and the second stepped surface 42 of the rotating ring 40 rotates along the inner circumferential surface of the second through hole 21 of the case 20. When the side of the groove 43 of the rotating ring 40 rotates to the position of the side of the rib 22, the rotation is blocked and stops. At this point, the dial 10 is rotated just to a desired angle. When the dial 10 is rotated backward, the dial returns to an original position. Of course, the dial 10 can rotate in both clockwise and anticlockwise directions.

Figure 10:
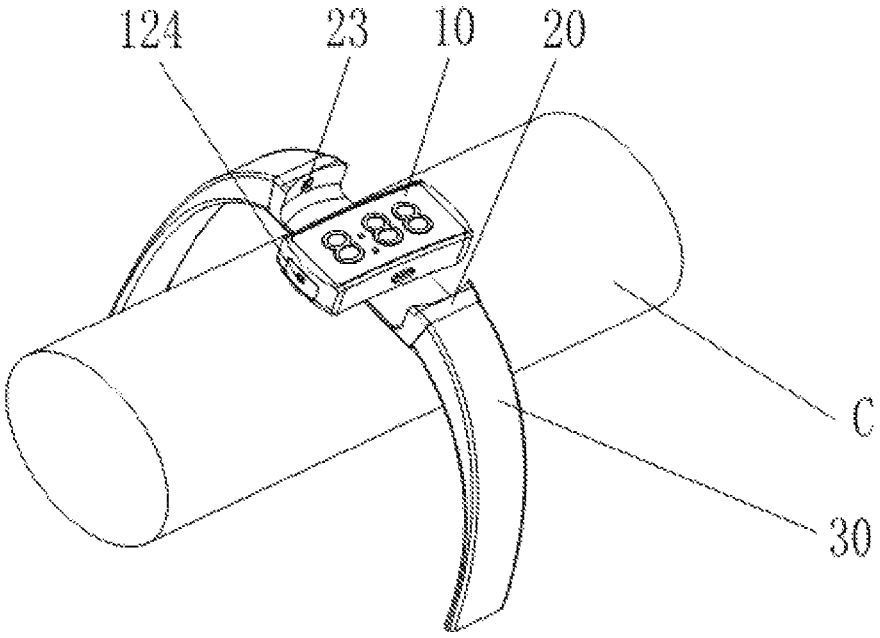
FIG. 10 is a schematic view of the structure of a smart wristband according to a particular embodiment of the present disclosure when it is to be charged after a dial is rotated.
Figure 11:
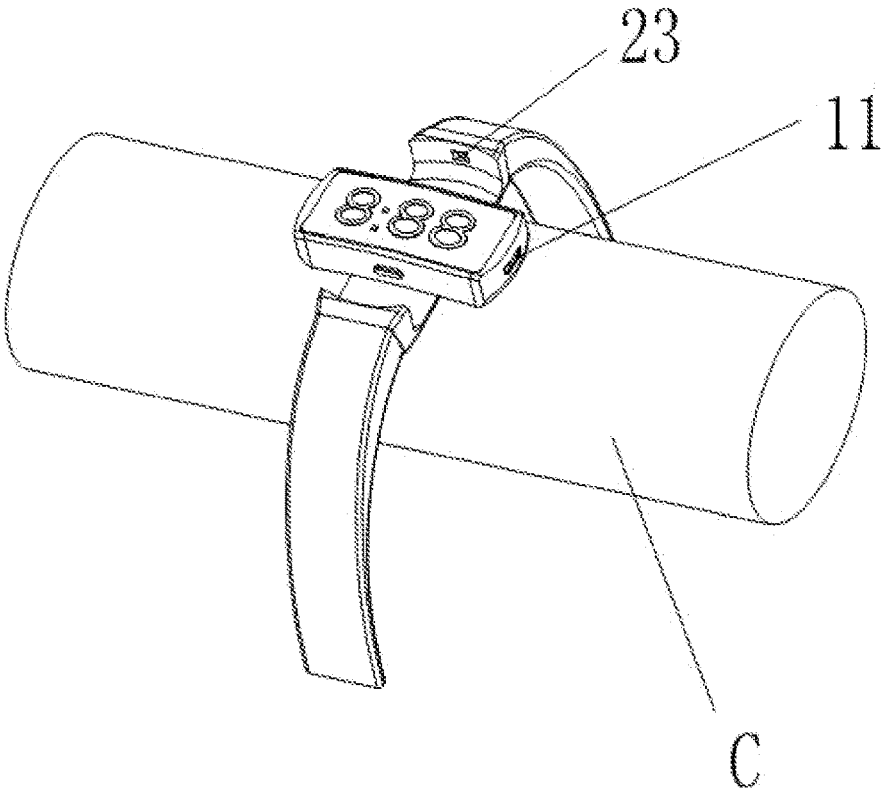
FIG. 11 is another schematic view of the structure of a smart wristband according to a particular embodiment of the present disclosure when it is to be charged after a dial is rotated.
Figure 12:
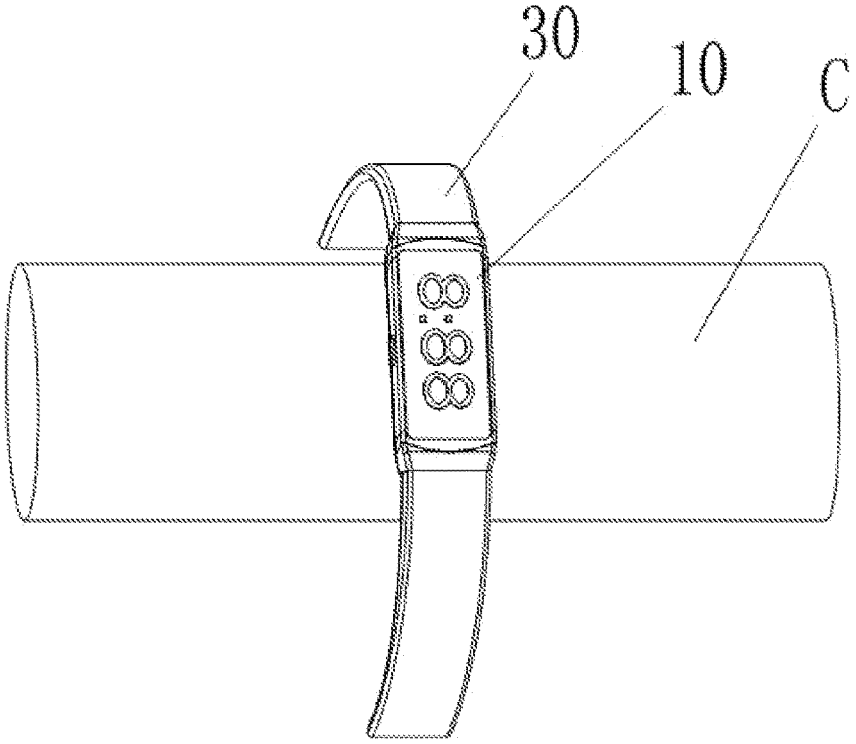
FIG. 12 is a schematic view of the structure of a smart wristband according to a particular embodiment of the present disclosure when it is normally used.

As shown in FIGS. 10-12, both end faces of the bottom case 12 in the length direction and the corresponding inner sides of the case 20 are concentric arc surfaces, and the dial 10 as a whole rotates along the circular orbit.

The assembly process will be described below in detail.

The FPC 13, the battery 14, the PCB 15, the LCD 16 and the lens 17 are individually assembled in the bottom case 12 and are formed into a whole by an adhesive. Then, the bottom case 12 is assembled and fixed with the metal rotating ring 40 by an adhesive with the case 20 sandwiched therebetween. Then the heart rate lens module 50 is attached with the metal rotating ring 40, and the assembly of the rotating assembly is completed.

Generally, the groove 43 on the rotating ring 40 has a sector angle of 120-300 degrees, and the rib 22 on the case 20 has a sector angle of 20-50 degrees. Herein, the sector angle refers to the angle between two hypothetical tangent lines from the center of the rotating ring 40 to the two sides of the groove or rib.

As shown in FIG. 8 and FIG. 11, an opening 123 is provided at an end of the bottom case 12 that is corresponding to the USB port 11, and the USB port 11 passes through the opening 123. In order to facilitate rotating of the dial 10 into position and keeping the stability after it gets into position, a protruding buckling rib 124 is provided at the other end of the bottom case 12, and a buckling groove 23 is formed at the corresponding position of the case 20 to engage with the protruding buckling rib 124. The protruding buckling rib 124 is engaged with the buckling groove 23, and when the dial 10 is being rotated, the engagement and disengagement between the protruding buckling rib 124 and the buckling groove 23 are corresponding to the engagement and disengagement between the dial 10 and the case 20.

Figure 6:
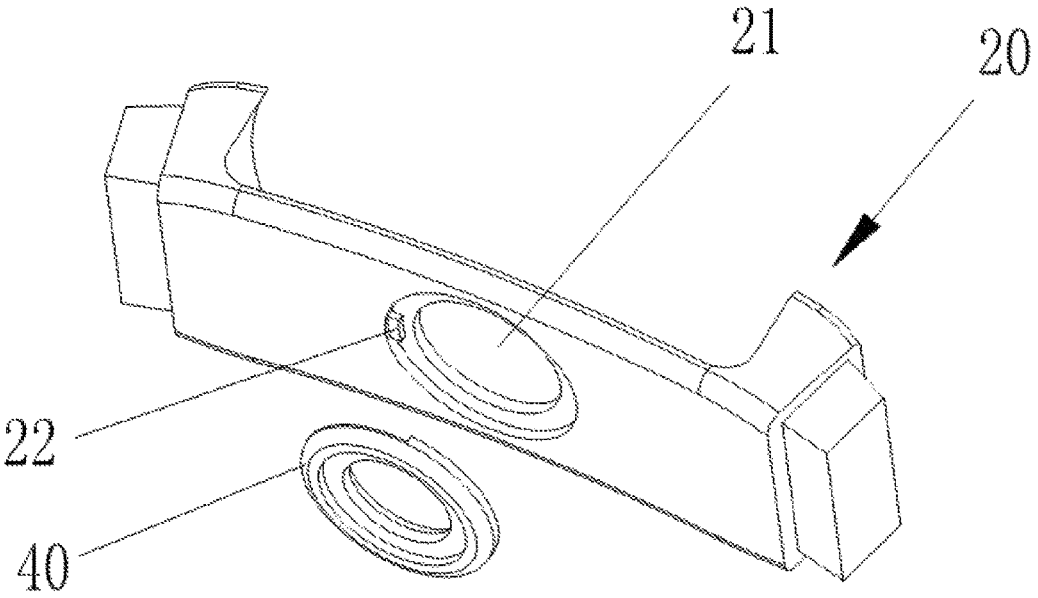
FIG. 6 is a schematic view of the structure of a case and a rotating ring of a smart wristband according to a particular embodiment of the present disclosure, in which the rotating ring and the case are separated.
Figure 7:
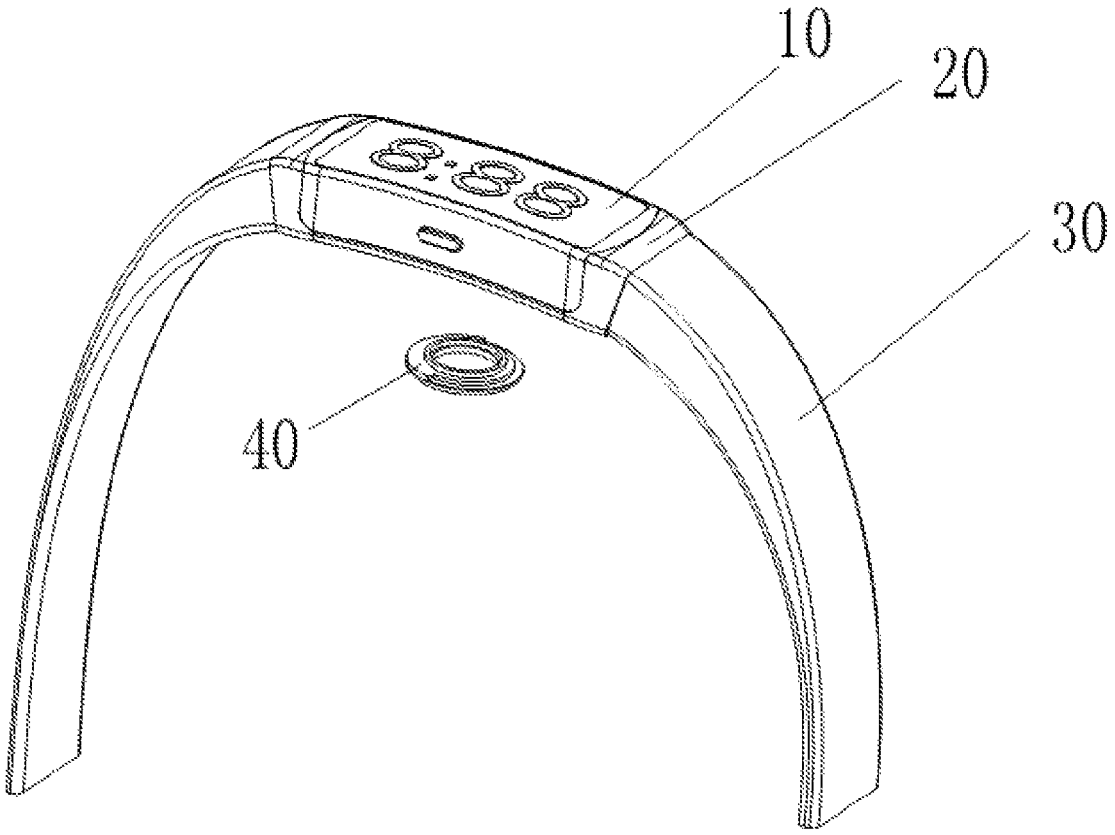
FIG. 7 is a schematic view of a top structure of a smart wristband according to a particular embodiment of the present disclosure, in which the rotating ring and the case are separated.

As shown in FIG. 6 and FIG. 8, the case 20 is disposed between the dial 10 and the metal rotating ring 40. The rotation and stopping are achieved by the engagement between the rib 22 on the case 20 and the groove 43 on the rotating ring 40. The angle of rotation is controlled by the angle on the rib 22 and the groove 43. The present disclosure shows an example that the dial 10 can rotate by 90 degrees in either of the two directions.

As shown in FIG. 9, the groove 43 of the rotating ring 40 has a sector angle of 200 degrees; that is, the angle between two hypothetical tangent lines from the center of the rotating ring 40 to the two sides of the groove 43 is exactly 200 degrees. In FIG. 10, the sector angle of the rib 22 is 20 degrees, and similarly, the angle between two hypothetical tangent lines from the center of the second through hole 21 to the two sides of the rib 22 is exactly 20 degrees. When assembled, the rib 22 and the groove 43 are in the same direction, and the rib 22 of 20 degrees is exactly in the middle of the groove 43 of 200 degrees. As 200 degrees minus 20 degrees is exactly 180 degrees, the dial 10 can only be rotated by 90 degrees in either the left direction or the right direction. When the dial 10 is being rotated to the left, the left side of the groove 43 coincides with a side of the rib 22, and the dial 10 stops rotating.

The structure shown in FIG. 9 is designed to control the rotation angle, by rotating the dial 10, the dial 10 can only rotate by 90 degrees to the left and to the right, as shown in FIG. 10 and FIG. 11.

In the above embodiment of the present disclosure, the smart wristband can be designed so that it can be used to illuminate when rotated, and the case and the band are decoratively lightened when not rotated.

The portion of the bottom case 12 that is corresponding to the protruding buckling rib 124 is made of transparent plastic. The transparent plastic area and the main body of the bottom case 12 are integrally molded by a two-color plastic injection molding machine. In other words, the transparent plastic area of the bottom case 12 is integrally provided with the main body, the transparent plastic area is only a transparent area provided on the bottom case 12, and they are injection molded together by a two-color plastic injection molding machine.

An LED 18 is provided at the bottom of an end of the PCB 15 that is corresponding to the transparent plastic area of the bottom case 12. The LED 18 serves as an internal light source of the dial 10 and also has a function of full charging alert, low battery alert, or call flashing reminder.

In order to facilitate passing through of the light from the internal light source, and make the case 20 and the band 30 bright, the case 20 is made of crystal black translucent hard plastic, and the band 30 is made of translucent silicone soft plastic, both of which are light transmittable. The case 20 and the band 30 may be formed integrally or separately.

The bottom case 12 is two-color injection molded, the bottom case 12 and the two-color injection molded area are formed integrally, and the two-color injection molded area is a transparent area. The case 20 and the band 30 may be formed integrally. The case 20 and the band 30 may also be formed separately. For example, the case 20 and the band 30 may be fixed by a screw or a rotating shaft connection. The case 20 is crystal black translucent, the band 30 is translucent silicone, and both are light transmittable.

When the case 20 and the band 30 adopt an integral structure, they have different characteristics. The case 20 is a transparent hard plastic, the band 30 is a soft plastic, and the case 20 and the band 30 may be formed by insert molding. The case 20 is injection molded first, and then it is put into a silicone mold and molded again. Further, the case 20 and the band 30 may also be formed separately, and fixed by a structure such as a normal rotating shaft or a screw.

In the above embodiment, the LED 18 is a light concentrated high-brightness LED. The light from the LED 18 is introduced into the two-color injection molded transparent area of the bottom case 12, and then is introduced into the crystal black translucent case 20. Since the band 30 is also translucent, the case 20 and the band 30 can be both bright. When the dial 10 is being rotated, the transparent area is bright and can be used as a flashlight at night. The area where the protruding buckling rib 124 is located in FIG. 10 is a two-color injection molded transparent area of the bottom case 12. When the dial 10 is not rotated, the light generated by the LED 18 can be used to decorate the case 20 and the band 30. The LED lamp can also be used in a function of full charging alert, low battery alert, or call flashing reminder, etc. A internal software is used to control the turning on/off of internal light sources, and the generation of signals or strong light of flashlight.

In the smart wristband of the present disclosure, the rotating shaft at the center of the bottom case 12 is hollow, and the rotation is achieved by connecting the bottom case 12 with the rotating ring 40 with the case 20 sandwiched therebetween. In the present disclosure, the dial 10 can rotate around the entire assembly surface of the rotating ring 40 and the case 20, and can stop the rotation by means of the rib 22 on the case 20.

The state of being used and charged of the smart wristband is as follows.

Referring to FIGS. 10-12, one end of the dial 10 is the USB port 11, and the other end is the protruding buckling rib 124. The buckling groove 23 is formed at the position of the case 20 that is corresponding to the protruding buckling rib 124. The C simulates the state wherein a person's wrist is lifted up. In a normal wearing state, the USB port 11 is hidden when the dial 10 is engaged with the case 20 (see FIG. 12), and the dial 10 is rotated to be charged when charging is needed (see FIGS. 10 and 11). Therefore, the dial 10 as a whole can be rotated, and the charging port can be hidden.

The working principle of the smart wristband of the present disclosure is as follows.

The USB charging port is hidden by rotating the dial 10, and the angle of rotation of the dial 10 is controlled by the rib 22 at the bottom of the metal bottom case 12, to adjust the optimal position suitable for human vision. Both sides of the dial 10 in the length direction are concentric arc surfaces, and the dial 10 as a whole rotates along with the circular orbit. The light transmittable area is formed by two-color injection molding, and a high concentrated LED is used as the internal light source.

The smart wristband of the present disclosure can realize a hidden charging port, a mechanical full-body rotation structure, illumination when rotated and decorative lighting of the case and the band when not rotated.

The above merely describes preferable embodiments of the present disclosure and is not intended to limit the present disclosure in any way. A person skilled in the art may use the technical contents disclosed above to modify or change equivalently to obtain other equivalent embodiments. However, any simple amendments, equivalent variations and modifications made to the above embodiments according to the technical essence of the present disclosure without departing from the technical solutions of the present disclosure shall still fall within the protection scope of the technical solutions of the present disclosure.

What is claimed is:

1. A smart wristband with a rotatable dial, comprising a dial, a case and a band, the case being embedded in the band, wherein the dial is rotatably disposed in the case, an end of the dial is provided with a USB port, and the USB port is hidden between the dial and the case;

a rotation structure of the dial is as follows:

the dial comprises a bottom case, a rotating ring is fixed at a bottom of the bottom case, the case is sandwiched between the bottom case and the rotating ring, and relative rotation between the dial and the case is achieved by the cooperation and relative rotation between the rotating ring and the case; and an opening is provided at an end of the bottom case corresponding to the USB port, the USB port passes through the opening, a protruding buckling rib is provided at the other end of the bottom case, and a buckling groove that matches the protruding buckling rib is formed at the corresponding position of the case.

2. The smart wristband with a rotatable dial according to claim 1, wherein the rotation structure of the dial is specifically as follows:

the bottom case as a whole is of a shape of a box having an upper opening, and a first through hole is provided at a center of the bottom of the bottom case as a rotating shaft of the dial;

a second through hole having a stepped surface is provided at a portion of the case corresponding to the first through hole of the bottom case, and a rib is provided on an inner circumferential surface of the second through hole;

an annular boss in a circumferential direction of the first through hole is provided at a lower portion of the first through hole, and the annular boss is inserted into the second through hole and is fixedly connected with the rotating ring;

a top surface of the rotating ring comprises a first stepped surface and a second stepped surface from interior to exterior from higher to lower, the second stepped surface is provided with a groove of a certain angle, and the second stepped surface of the rotating ring is engaged with the inner circumferential surface of the second through hole; and when the dial is being rotated, the annular boss at the lower portion of the bottom case drives the rotating ring to rotate, and the second stepped surface of the rotating ring rotates along the inner circumferential surface of the second through hole of the case, and when a groove side of the rotating ring rotates to the position of a rib side, the rotation is blocked and stops, at this point the dial is rotated just to a desired angle; and when the dial is rotated backward, the dial returns to an original position.

3. The smart wristband with a rotatable dial according to claim 2, wherein the groove on the second stepped surface of the rotating ring has a sector angle of 120-300 degrees, and the rib on the case has a sector angle of 20-50 degrees.

4. The smart wristband with a rotatable dial according to claim 1, wherein a heart rate lens module is provided under the rotating ring.

5. The smart wristband with a rotatable dial according to claim 1, wherein an FPC, a battery, a PCB, an LCD and a lens are provided sequentially in the bottom case from bottom to top, which are fixed with the bottom case by an adhesive.

6. The smart wristband with a rotatable dial according to claim 5, wherein a portion of the bottom case corresponding to the protruding buckling rib is made of transparent plastic, and the transparent plastic area and a main body of the bottom case are integrally molded by using a two-color plastic injection molding machine; and an LED is provided at the bottom of an end of the PCB corresponding to the transparent plastic area of the bottom case, and the LED serves as an internal light source of the dial and also has a function of full charging alert, low battery alert, or call flashing reminder.

7. The smart wristband with a rotatable dial according to claim 6, wherein the case is made of crystal black translucent hard plastic, the band is made of translucent silicone soft plastic, and the case and the band are formed integrally or separately.

8. The smart wristband with a rotatable dial according to claim 1, wherein both end faces of the bottom case in the length direction and corresponding inner sides of the case are concentric arc surfaces, and the dial as a whole rotates along a circular orbit.

* * * * *